US006493949B2

(12) United States Patent
Kondo et al.

(10) Patent No.: US 6,493,949 B2
(45) Date of Patent: Dec. 17, 2002

(54) CHAIN SAW WITH AN IMPROVED CHAIN TENSIONING ARRANGEMENT

(75) Inventors: Masaki Kondo, Anjo; Hideyuki Nakadachi, Toyohashi, both of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/858,615

(22) Filed: May 16, 2001

(65) Prior Publication Data

US 2001/0042311 A1 Nov. 22, 2001

(30) Foreign Application Priority Data

May 19, 2000 (JP) ..... 2000-148967

(51) Int. Cl.[7] ..... B27B 17/02
(52) U.S. Cl. ..... 30/386; 30/383
(58) Field of Search ..... 30/386, 383, 385

(56) References Cited

U.S. PATENT DOCUMENTS

| | | | | |
|---|---|---|---|---|
| 4,316,327 A | * | 2/1982 | Scott et al. | 30/386 |
| 4,382,334 A | * | 5/1983 | Reynolds | 30/386 |
| 5,491,899 A | | 2/1996 | Schliemann et al. | 30/386 |
| 5,522,143 A | | 6/1996 | Schliemann et al. | 30/386 |

FOREIGN PATENT DOCUMENTS

| | | | |
|---|---|---|---|
| DE | 4436543 | A1 | 5/1995 |
| DE | 19805821 | A1 | 8/1998 |

* cited by examiner

*Primary Examiner*—Douglas D. Watts
(74) *Attorney, Agent, or Firm*—Lahive & Cockfield, LLP

(57) ABSTRACT

A chain saw (1) includes a guide bar (5) supporting a chain (7) and attached to a main body (3). Disposed within the body is an anchor bolt (9) for securing the guide bar to the main body. Disposed within a sprocket cover (8) is a hexagonal nut (11) screwed onto the anchor bolt. Furthermore, provided coaxially with the hexagonal nut is a cylindrical element (15) having a hexagonal cavity (13) that engages the hexagonal nut and is axially movable and rotatable about the same axis as the hexagonal nut. Also provided is a lever (17) disposed at the outer end of the cylindrical element. Provided within the sprocket cover are an adjustment pin (19) engaging the guide bar, a screw stock (20) onto which the adjustment pin is threaded and which extends in the axial direction of the guide bar, a first helical gear (21) disposed at one end of the screw stock, and a second helical gear (23) meshing with the first helical gear. Further provided is a rotating element (25) coaxial with the second helical gear. Rotation of the lever and thus the rotating element from the exterior of the saw causes rotation of the second helical gear.

13 Claims, 15 Drawing Sheets

CHAIN SAW WITH AN IMPROVED CHAIN TENSIONING ARRANGEMENT

RELATED APPLICATIONS

This application claims priority to Japanese Patent Application No. 2000-148967 filed on May 19, 2000 in Japan. The contents of the aforementioned application are hereby incorporated by reference.

BACKGROUND OF THE INVENTION

1. Field of the Invention

The present invention relates to chain saws. More particularly, the present invention relates to a chain saw which requires no separate tool for adjustment of the chain tension of the chain saw.

2. Description of the Related Art

A conventional chain saw includes a guide bar that supports the saw's chain, with an anchor bolt and hexagonal nut provided so as to secure the guide bar to the main body of the chain saw. The chain saw is further constructed such that the guide bar is movable in the axial direction so as to allow adjustment of the chain tension. Conventionally, the process of axially moving the guide bar involves a procedure whereby a hex wrench is first used to loosen the above-mentioned hexagonal nut, a screwdriver is then inserted from the forward-facing side of the chain saw, and then the screwdriver is used to rotate an adjustment screw that causes the guide bar to move in the axial direction.

While this adjustment mechanism achieves its intended objective, it is not free from certain problems and inconveniences, thus leaving room for further improvement. For example, such a system requires the use of additional tools, namely a hex wrench and screwdriver, in order to perform adjustment of the tension of the saw's chain. Furthermore, the necessity of inserting the screwdriver from the forward-facing side of the chain saw to adjust the chain tension presents further difficulty in performing this procedure.

SUMMARY OF THE INVENTION

In view of the above-identified problems, an important object of the present invention is to provide a chain saw with improved operability.

Another important object of the present invention is to provide a chain saw that requires no separate or additional tools for adjustment of the chain tension.

To achieve these objectives, the present invention provides a chain saw which comprises: a main body; a chain; a guide bar for supporting the chain; an anchor bolt that has an axis and is disposed within the chain saw, the anchor bolt securing the guide bar to the main body; a hexagonal nut that threadably engages the anchor bolt; a cylindrical element provided along the same axis as the hexagonal nut and adapted to be both axially movable and rotatable about the same axis as the hexagonal nut, the cylindrical element including, at one end thereof that faces the hexagonal nut, a hexagonal cavity that is adapted to engage the hexagonal nut; a lever disposed on the opposing end of the cylindrical element from the hexagonal cavity of the cylindrical element, the lever being adapted to move between a raised position and a lowered position; an adjustment pin that engages the guide bar; a screw stock that both threadably engages the adjustment pin and extends along an axis of the guide bar; a first helical gear disposed at one end of the screw stock; a second helical gear that has an axis of rotation and meshes with the first helical gear such that rotation of the second helical gear causes rotation of the first helical gear; a rotating element disposed along the same axis of rotation as that of the second helical gear, wherein rotation of the rotating element causes rotation of the second helical gear; and a sprocket cover provided on a side face of the main body, the sprocket cover defining an interior and an exterior thereof. In this chain saw, the rotating element and the lever are so arranged as to permit their operation from the exterior of the sprocket cover, and pulling the lever up to the raised position and moving the lever along the axis of the anchor bolt allows the cylindrical element to engage the hexagonal nut.

According to this chain saw, when adjusting the chain tension of the chain saw, the lever is first pulled to a raised position and then pressed toward the interior of the machine, thus causing engagement between the hexagonal cavity of the cylindrical element and the hexagonal nut. While in this position, the lever is then rotated, thus loosening the hexagonal nut. The rotating element is then rotated so as to cause rotation of the second helical gear in a desired direction. The rotation of the second helical gear also causes rotation of the first helical gear with which it is engaged. This in turn causes rotation of the screw stock, which causes the adjustment pin to travel in the axial direction of the guide bar as it is rotated. In this fashion, as the adjustment pin moves in the axial direction of the guide bar, it also causes axial movement of the guide bar. In this manner, the axial movement of the guide bar permits adjustment of the chain tension. When the adjustment of the chain tension is completed, the lever is pressed toward the interior of the chain saw, causing engagement between the hexagonal cavity of the cylindrical element and the hexagonal nut, and the lever is rotated in the direction opposite that mentioned above. This allows tightening of the hexagonal nut, thus securing the guide bar to the main body of the chain saw. In this manner, adjustment of the tension of the chain can be achieved without the use of either a hex wrench or screwdriver. Additionally, this construction greatly simplifies the process for adjusting the chain tension.

In one aspect of the present invention, the hexagonal nut, the cylindrical element, the adjustment pin, the screw stock, and the first helical gear and second helical gear are disposed in the interior of the sprocket cover such that they are integrally removable with the sprocket cover from the chain saw and attachable with the sprocket cover to the chain saw. With a chain saw so constructed, the hexagonal nut and other components are not only removed along with the sprocket cover when the sprocket cover is removed from the chain saw, but are also disposed in the sprocket cover, thus helping to prevent loss of any of the various components.

Furthermore, according to yet another aspect of the present invention, the lever is favorably constructed in a manner wherein rotation of the rotating element is at least hindered due to the rotating element being covered by the lever when the lever is in the lowered position. According to this construction, rotation of the rotating element is obstructed when the lever is in the lowered position, thus allowing prevention of unreasonable force being applied to the adjustment pin.

Furthermore, according to another aspect of the present invention, the lever is most favorably constructed such that it is provided with a structure that maintains it in the raised position as it engages the outer surface of the cylindrical element when the lever is in the raised position. This construction allows the lever to remain in the raised position, enabling the lever to be rotated with greater ease.

According to yet another aspect of the present invention, the rotating element is most favorably constructed in a manner whereby the rotating element includes at least one lug on its surface, and further wherein the lug can be grasped with the fingers when being rotated. This construction also facilitates rotation of the rotating element.

In one aspect of the present invention, the rotating element has a generally columnar shape having a top surface located substantially flush with an outer surface of the sprocket cover, and the sprocket cover includes a pair of recessed areas formed in the outer surface along the rotating element for facilitating manual rotation of the rotating element.

In another aspect of the present invention, when in the lowered position, the lever covers at least part of the rotating element and at least one of the recessed areas. According to this construction, rotation of the rotating element is obstructed when the lever is in the lowered position, thus allowing prevention of undesirable force being applied to the adjustment pin.

In yet another aspect of the present invention, the lever is attached to said opposing end of the cylindrical element so as to be pivotal between the lowered and raised positions. According to this construction, when folded in the lowered position, the lever does not hinder the use of the chain saw.

In still another aspect of the present invention, the sprocket cover includes a setting hole and the lever includes a protrusion for engaging the setting hole when the lever is in the lowered position such that engagement of the protrusion with the setting hole maintains the lever in the lowered position. This construction enables the lever to remain securely in the lowered position.

In one preferred mode, the sprocket cover includes a first rib and the lever includes a second rib adapted to engage the first rib when the lever is in the lowered position such that engagement of the two ribs maintains the lever in the lowered position.

In another preferred mode, rotation of the rotating element causes rotation of the screw stock, which causes the adjustment pin to rotate and move on the screw stock along the axis of the guide bar, thus moving the guide bar along the axis thereof.

In one aspect, when the hexagonal cavity of the cylindrical element is in engagement with the hexagonal nut, the hexagonal nut is adapted to be both loosened from the anchor bolt by manual rotation of the lever to permit axial movement of the guide bar and tightened on the anchor bolt to secure the guide bar to the main body.

In one embodiment, the present invention provide a chain saw comprising: a main body; a chain; a sprocket for transmitting rotation from the main body to the chain; a guide bar for supporting the chain; first means and second means adapted to cooperate to secure the guide bar to the main body; and a sprocket cover partially covering the sprocket, the chain, and the guide bar. In this chain saw, the first means is provided in the main body and the second means is disposed within the sprocket cover. This chain saw further comprises means for adjusting the tension of the chain disposed adjacent to the second means within the sprocket cover so as to allow both securing of the guide bar and adjustment of the tension of the chain without the use of any tool.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawing, in which.

DETAILED DESCRIPTION OF THE PREFERRED EMBODIMENTS

Preferred embodiments according to the present invention will be described hereinafter with reference to the attached drawings.

Embodiment 1

Figure 1:
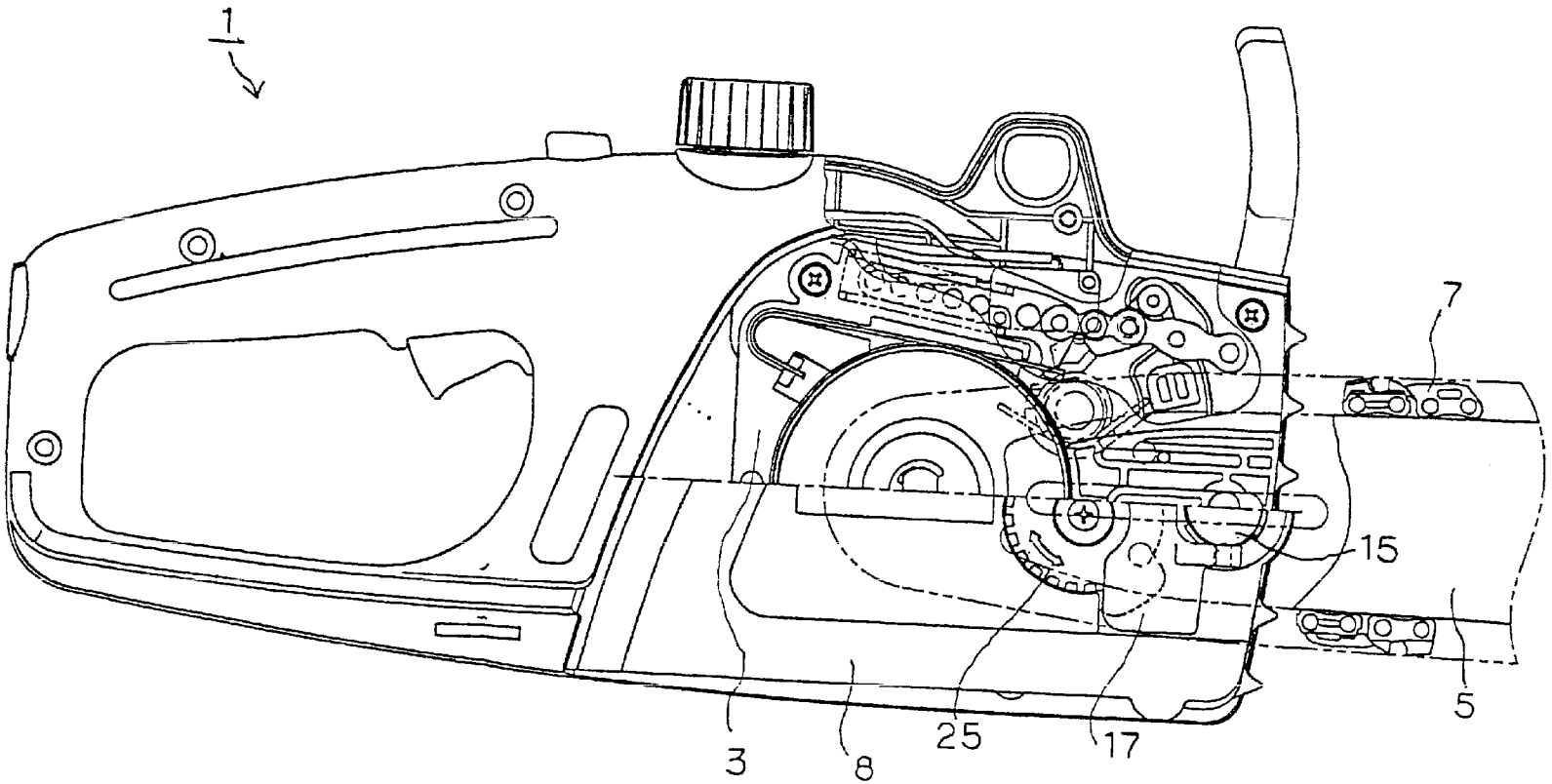
FIG. 1 is a side view showing the main portion of a chain saw in accordance with a first embodiment of the present invention.

FIG. 1 shows a chain saw 1 according to the present invention that includes a guide bar 5 that is attached to and extends forward (to the right as shown in this figure) from the main body 3 of the chain saw 1. Attached to the guide bar 5 is a chain 7, with a sprocket cover 8 enclosing the sprocket section of the guide bar 5.

Figure 2:
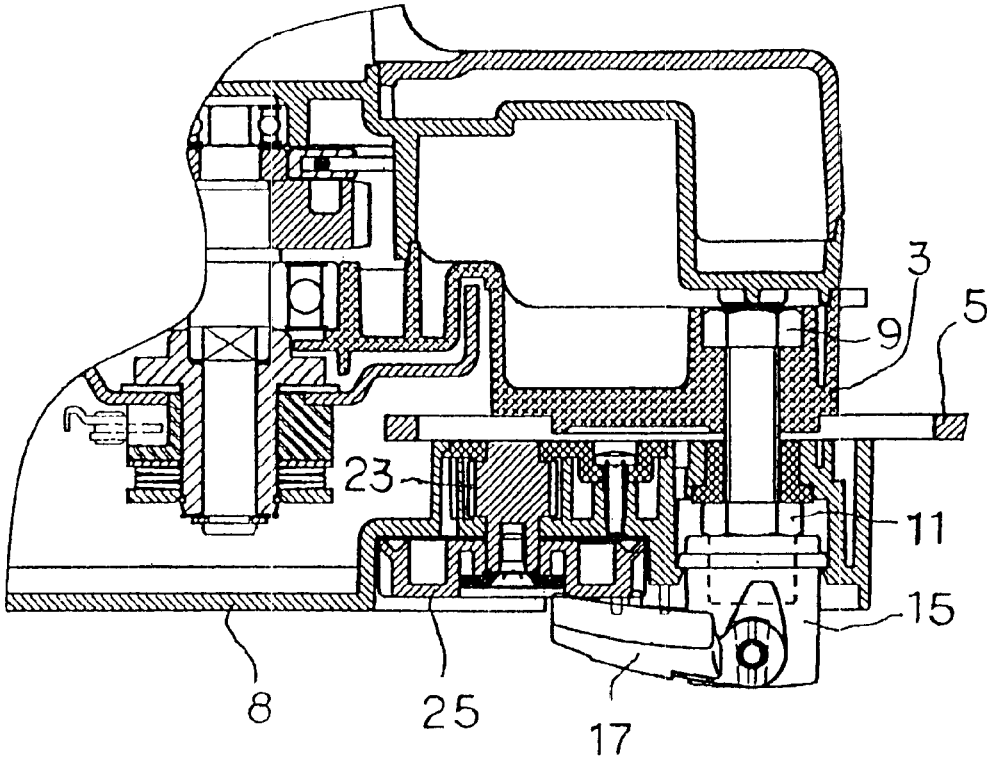
FIG. 2 is a cross-sectional view showing the main portion of the chain saw in accordance with the first embodiment.
Figure 3:
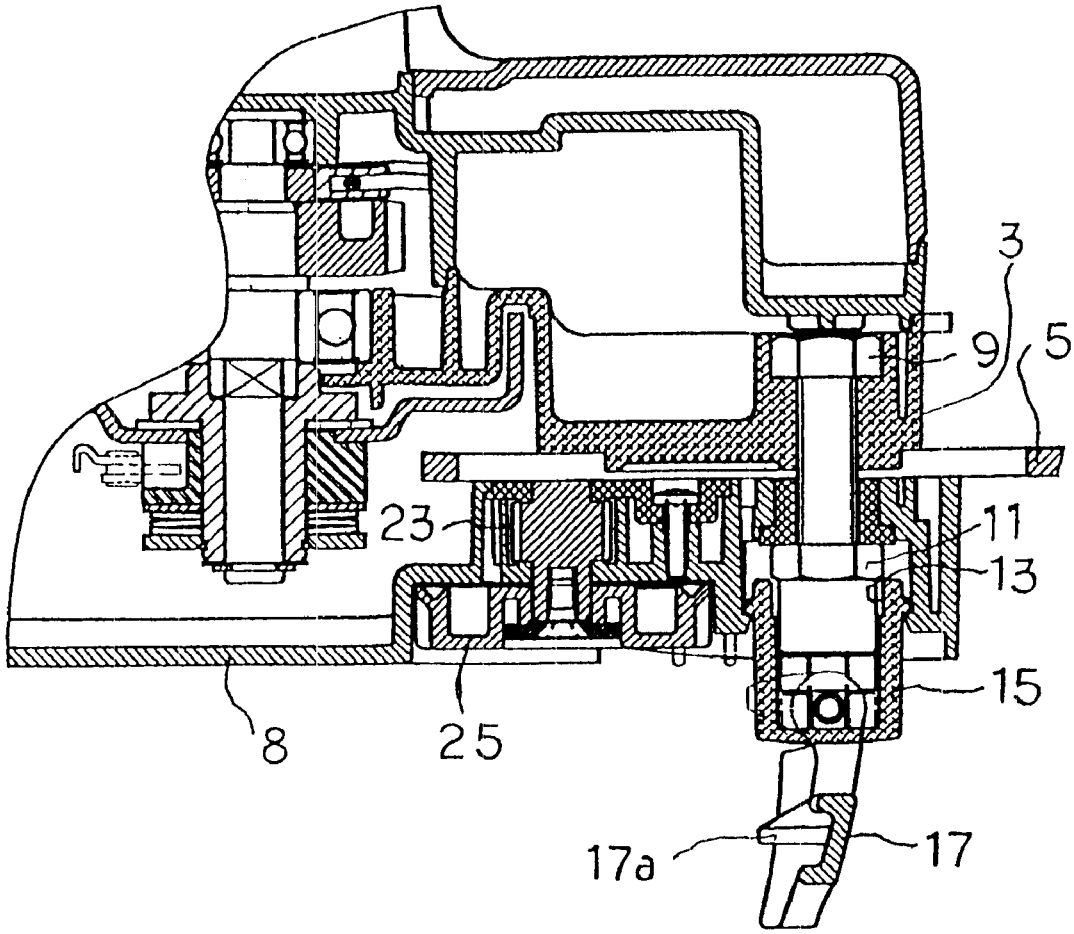
FIG. 3 is a cross-sectional view showing the main portion of the chain saw in accordance with the first embodiment.
Figure 4:
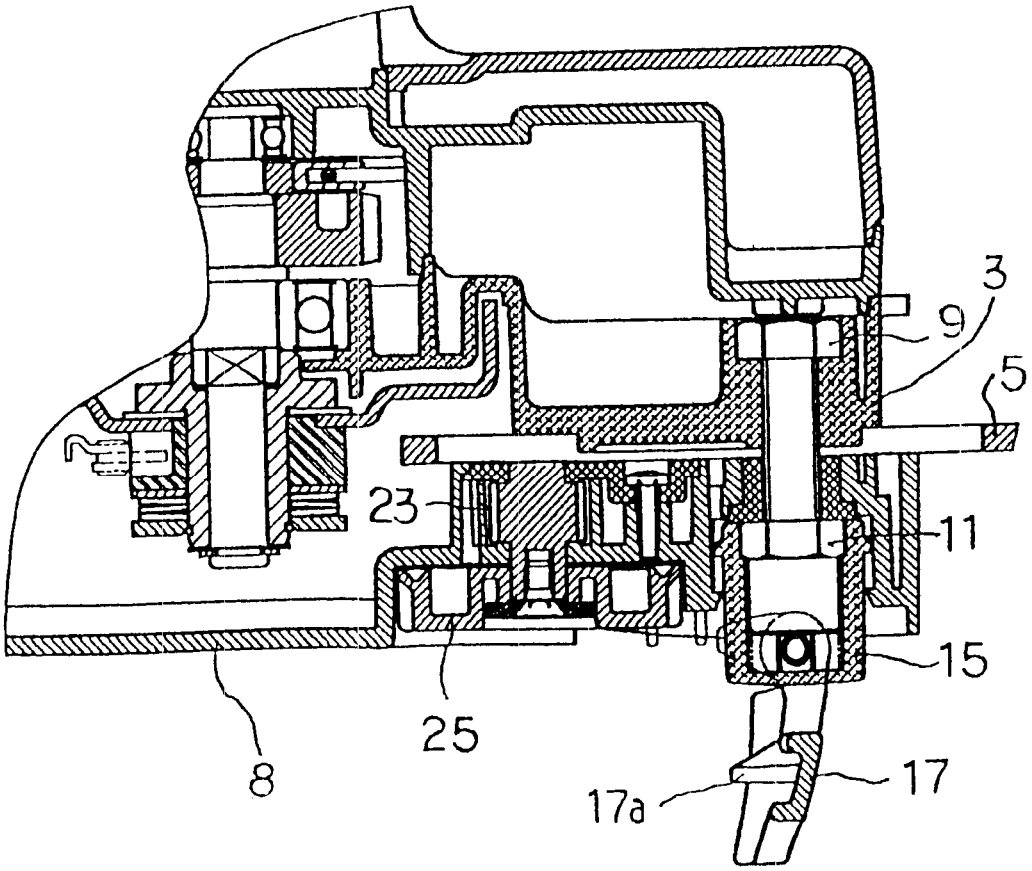
FIG. 4 is a cross-sectional view showing the main portion of the chain saw in accordance with the first embodiment.
Figure 5:
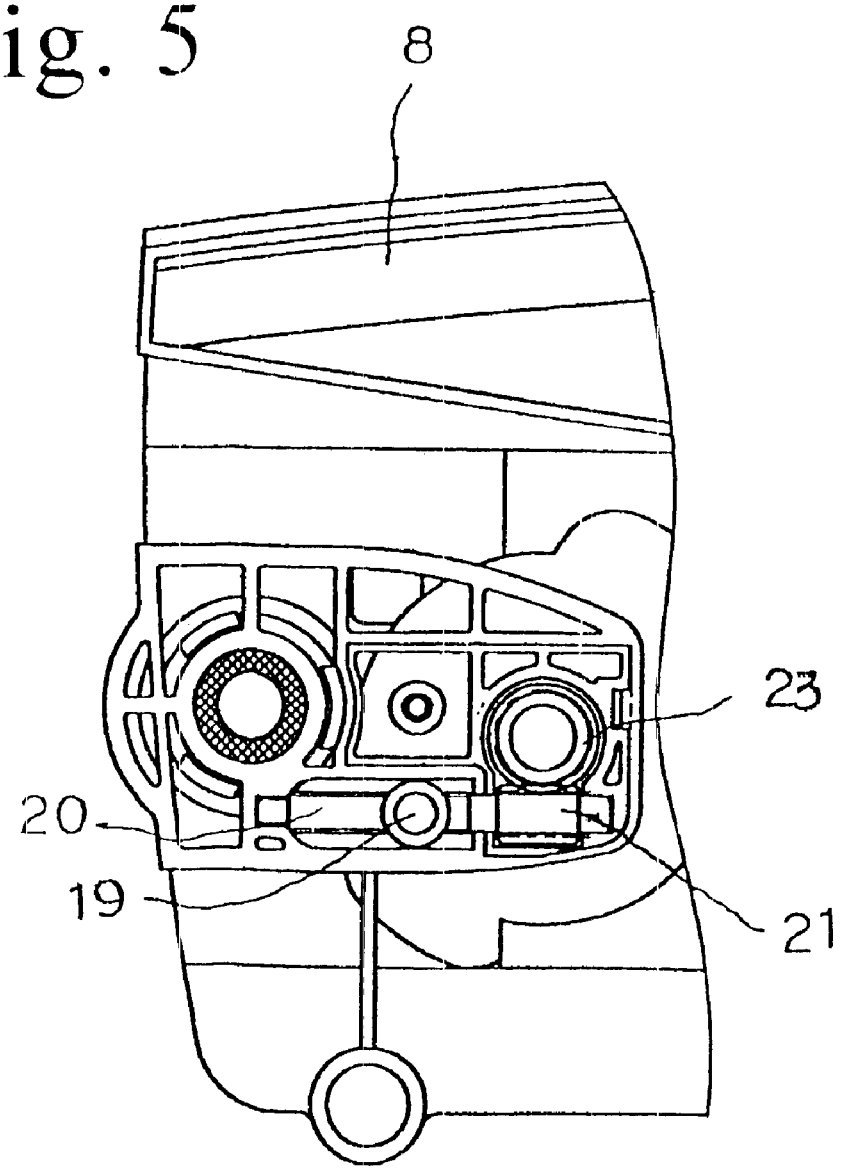
FIG. 5 is a rear view showing the main portion of the sprocket cover assembly of the chain saw in accordance with the first embodiment.
Figure 6:
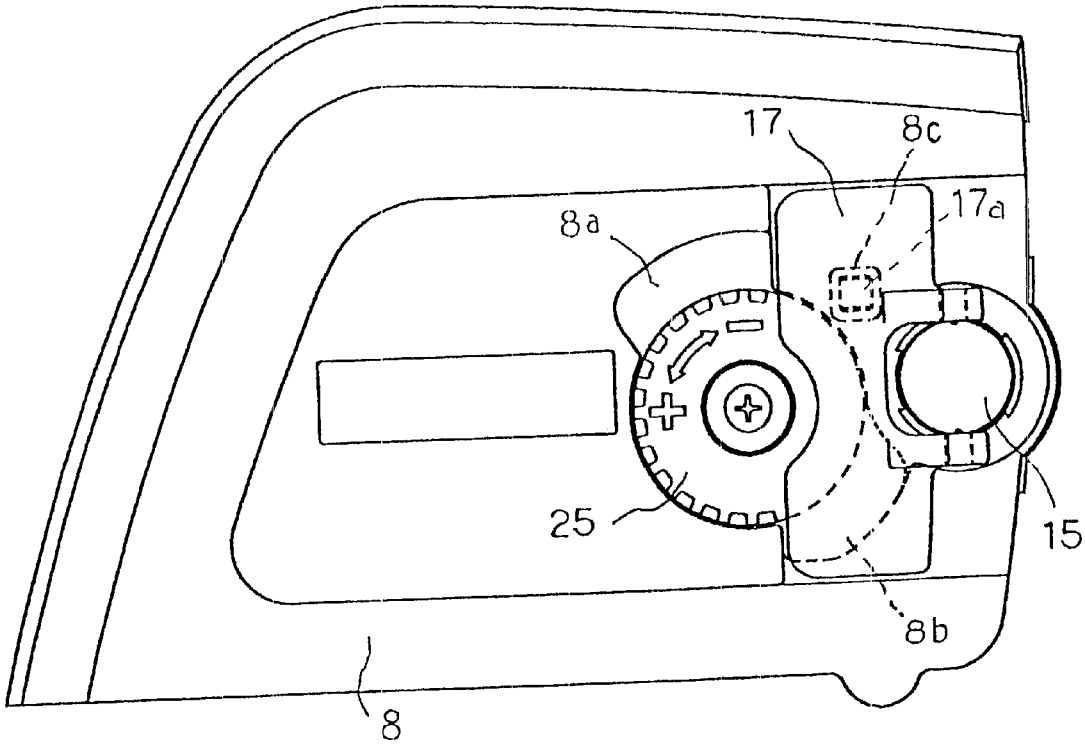
FIG. 6 is a front view showing the main portion of the sprocket cover assembly of the chain saw in accordance with the first embodiment.

FIG. 2 shows the interior of the chain saw 1, wherein disposed in the interior of the chain saw 1 is an anchor bolt 9 for securing the guide bar 5 to the main body 3 of the chain saw, and further wherein disposed in the interior of the sprocket cover 8 is a hexagonal nut 11 that is screwed onto the anchor bolt 9. Furthermore, as shown in FIGS. 2 through 4, provided along the same axis as the hexagonal nut 11 is a cylindrical element 15 which has a hexagonal cavity 13 that engages the head portion of the hexagonal nut 11 and is both axially movable and rotatably movable about the same axis as the hexagonal nut 11. Also provided is a raisable lever 17 disposed at the opposite end of the cylindrical element 15 from the hexagonal cavity 13. Furthermore, as shown in FIG. 5, provided in the interior of the sprocket cover 8 are an adjustment pin 19 that engages the guide bar 5, a screw stock 20 onto which the adjustment pin 19 is threaded and which extends in the axial direction of the guide bar 5, a first helical gear 21 disposed at one end of the screw stock 20, and a second helical gear 23 that meshes with the first helical gear 21. Further provided, as shown in FIGS. 2 through 4 and FIG. 6, is a rotating element 25 that is attached along the same axis as the second helical gear 23, wherein rotation of the rotating element 25 causes rotation of the second helical gear 23. As can be seen in FIGS. 1 and 6, the rotating element 25 and lever 17 are disposed so as to be operable from the exterior of the sprocket cover 8. As shown in FIGS. 3 and 4, the lever 17 is constructed such that raising the lever 17 permits the cylindrical element 15 to be pressed into the interior of the chain saw, thus causing engagement of the cylindrical element 15 with the hexagonal nut 11.

Provided in the sprocket cover 8, as shown in FIG. 6, are recessed areas 8*a* and 8*b* which accommodate the operator's fingers so as to facilitate rotation of the rotating element 25. The lever 17 is constructed such that it covers the recessed area 8*b* when in the lowered position. When in this position, the lever 17 hinders rotation of the rotating element 25. Furthermore, as shown in FIGS. 3 and 4, a protrusion 17*a* is disposed on the lever 17 for the purpose of maintaining the lever in the lowered position. This holding protrusion 17*a* is constructed such that when the lever 17 is in the lowered position, as shown in FIG. 6, the protrusion 17*a* is inserted in a setting hole 8*c* disposed in the sprocket cover 8. As shown in FIG. 6, approximately one-half of the rotating element 25 is covered when the lever 17 is in the lowered position, thus hindering inadvertent rotation of the rotating element 25.

Figure 7:
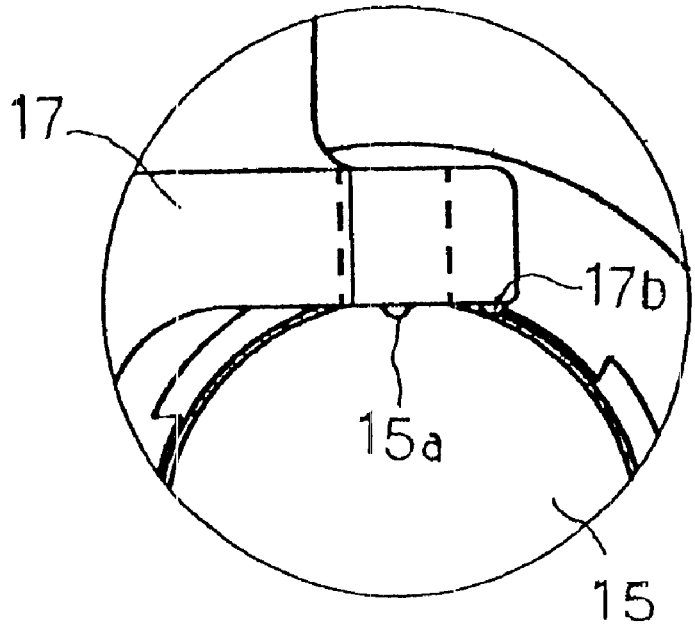
FIG. 7 is an enlarged view showing the main portion of the section in which a lever and a cylindrical element of the chain saw in accordance with the first embodiment are connected.

Furthermore, as shown in the enlarged view of FIG. 7, a groove 15*a* is axially disposed along the side of the cylindrical element 15, while disposed at the rear end of the lever 17 is a protrusion 17*b*. In this arrangement, when the lever 17 is pulled up, the protrusion 17*b* engages the groove 15*a*, allowing the lever 17 to remain in the raised position.

When adjusting the tension of the chain 7 of the chain saw 1, the lever 17 is first pulled up and then pressed into the interior of the chain saw, causing engagement of the hexagonal cavity 13 of the cylindrical element 15 with the hexagonal nut 11. In this condition, the lever 17 is then rotated so as to loosen the hexagonal nut 11. Next, the rotating element 25 is rotated so as to rotate the second helical gear 23 in the desired direction. As the second helical gear 23 rotates, the first helical gear 21 to which it engages also rotates. This in turn causes rotation of the screw stock 20. The adjustment pin 19, which is threadably engaged to the screw stock 20, is moved in the axial direction of the guide bar 5, thus causing the guide bar 5 to move in the axial direction as well. This axial movement of the guide bar 5 permits adjustment of the tension of the chain 7. When adjustment of the tension of the chain 7 is completed, the lever 17 is pressed in toward the interior of the chain saw, whereupon the hexagonal cavity 13 of the cylindrical element 15 engages the hexagonal nut 11, and the lever 17 is rotated in the direction opposite that used previously. This rotates the hexagonal nut 11 so as to tighten the nut, thereby allowing the guide bar 5 to be secured to the main body 3 of the chain saw. In this manner, in the chain saw 1 according to the present invention, adjustment of the tension of the chain 7 can be accomplished without the use of any wrench, screwdriver, or other such tool. Furthermore, the construction of this mechanism is such that the procedure for adjusting the chain tension is greatly simplified.

Embodiment 2

Figure 8:
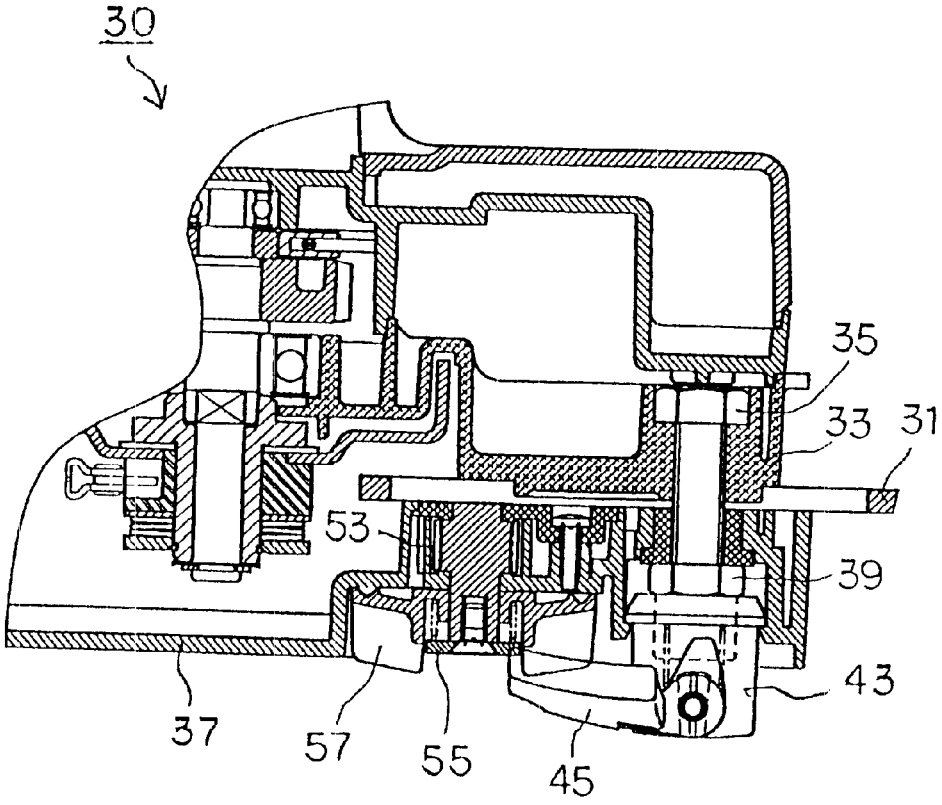
FIG. 8 is a cross-sectional view showing the main portion of a chain saw in accordance with a second embodiment of the present invention.
Figure 9:
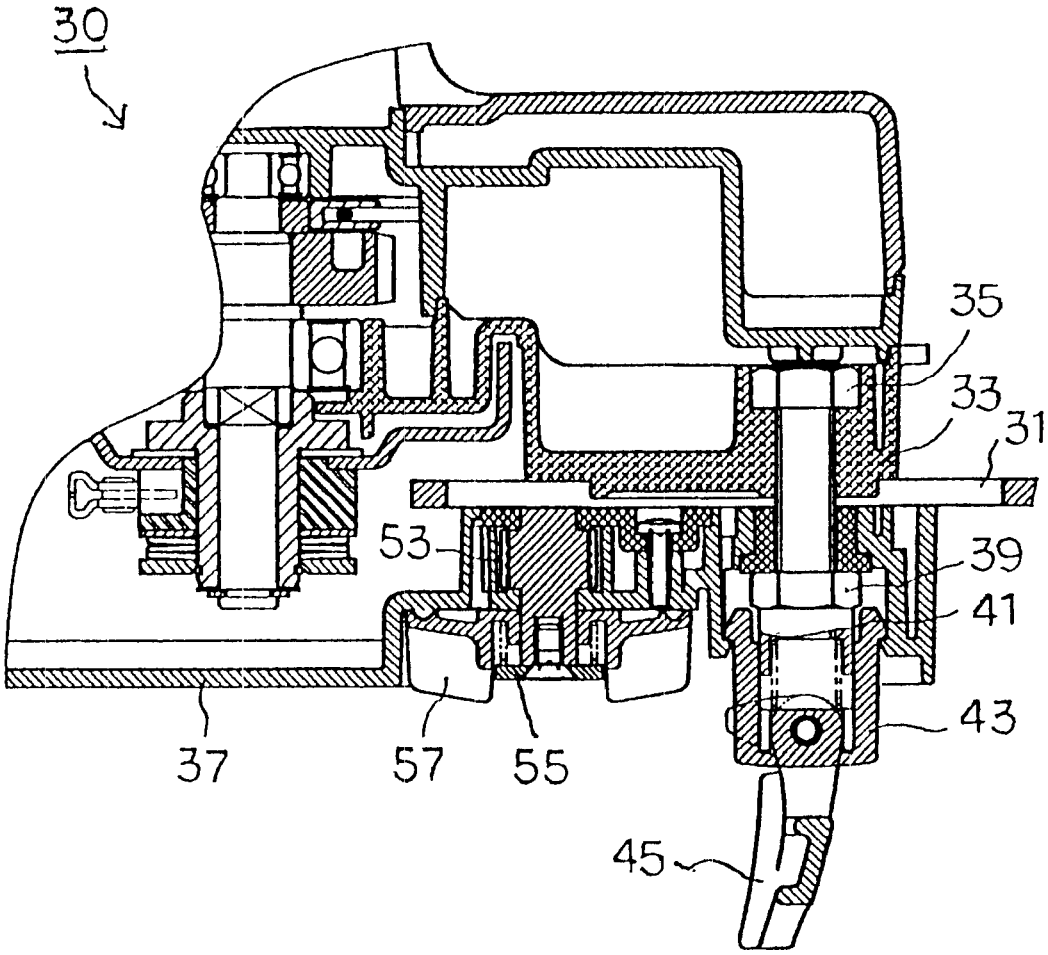
FIG. 9 is a cross-sectional view showing the main portion of the chain saw in accordance with the second embodiment.
Figure 10:
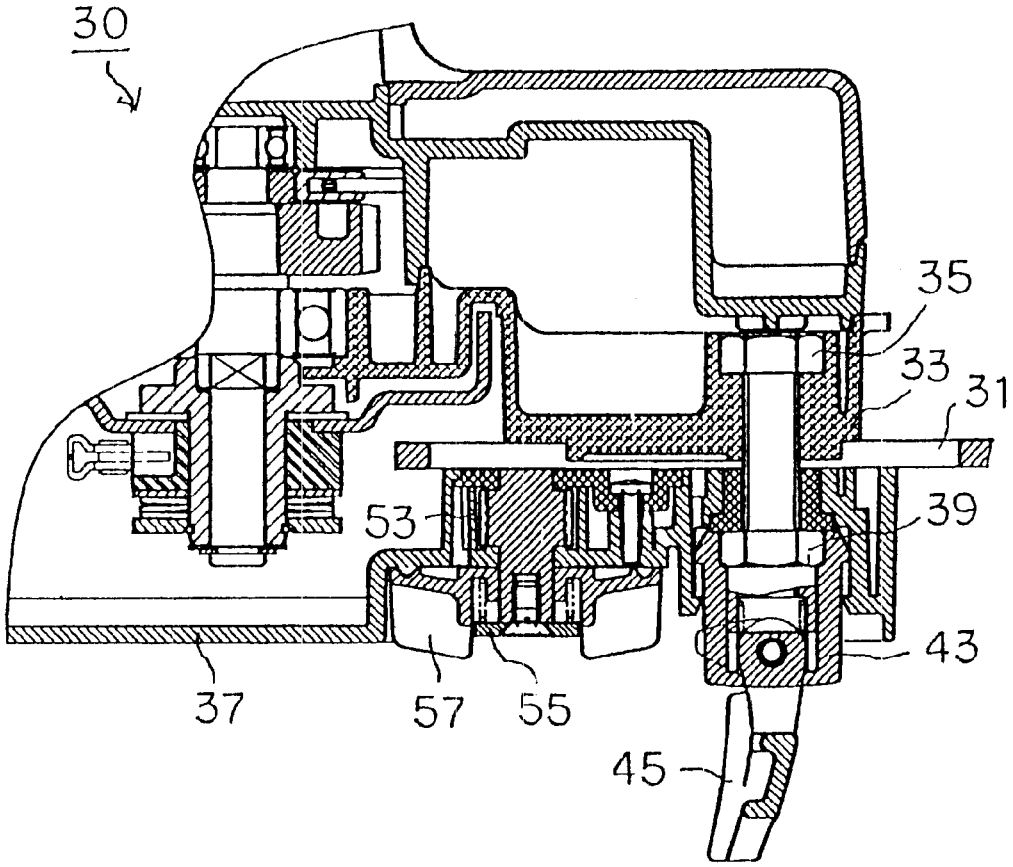
FIG. 10 is a cross-sectional view showing the main portion of the chain saw in accordance with the second embodiment.
Figure 11:
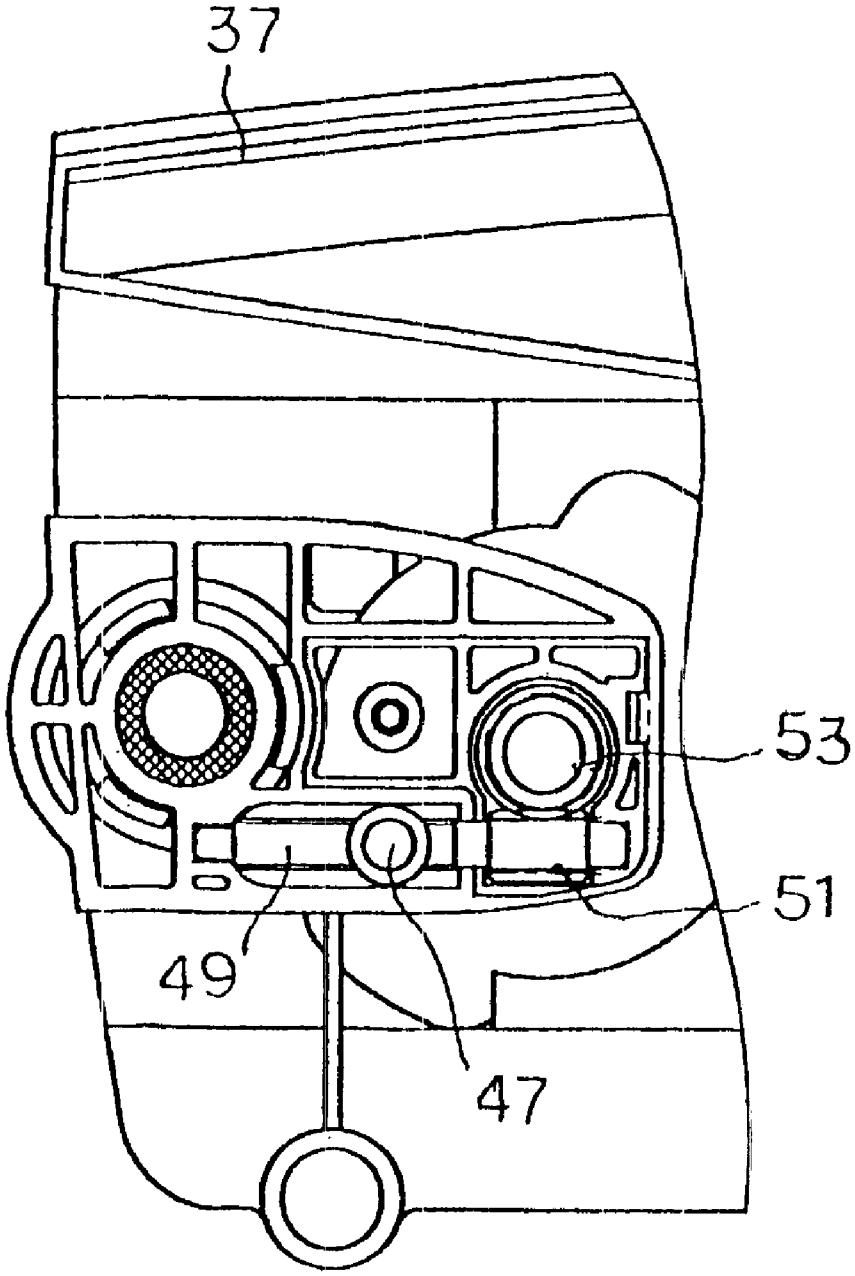
FIG. 11 is a rear view showing the main portion of the sprocket cover assembly of the chain saw in accordance with the second embodiment.
Figure 12:
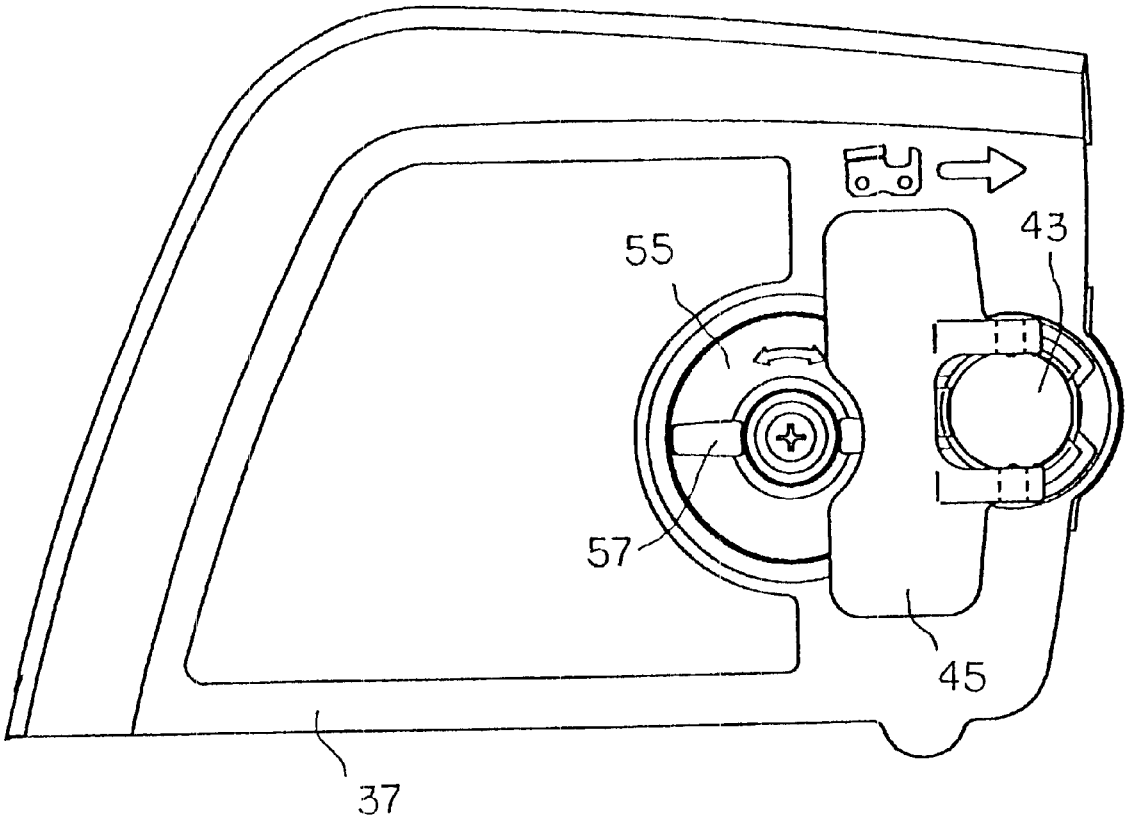
FIG. 12 is a front view showing the main portion of the sprocket cover assembly of the chain saw in accordance with the second embodiment.

An alternative embodiment of the present invention will be described hereinafter with reference to the attached drawings. This embodiment differs from the previous embodiment in that it further enhances the operability of the chain saw. According to this second embodiment, a chain saw 30 is of substantially similar construction to the chain saw 1 of the first embodiment, and as is shown in FIG. 8, has an anchor bolt 35 disposed in the interior of the chain saw 30 for securing a guide bar 31 to the saw's main body 33 and a hexagonal nut 39 disposed in the interior of a sprocket cover 37, with the hexagonal nut engaging the anchor bolt 35. Additionally, as shown in FIGS. 8 through 10, provided along the same axis as the hexagonal nut 39 is a cylindrical element 43 that has a hexagonal cavity 41 that engages the head portion of the hexagonal nut 39 and that is both axially movable and rotatable about the above-mentioned axis. Also provided is a raisable lever 45 disposed at the opposite end of the cylindrical element 43 from the hexagonal cavity 41. Furthermore, as shown in FIG. 11, provided in the interior of the sprocket cover 37 are an adjustment pin 47 that engages the guide bar 31, a screw stock 49 onto which the adjustment pin 47 is threaded and which extends in the axial direction of the guide bar 31, a first helical gear 51 disposed at one end of the screw stock 49, and a second helical gear 53 that meshes with the first helical gear 21. Further disposed, as shown in FIGS. 8 through 10 and FIG. 12, is a rotating element 55 that is attached along the same axis as the second helical gear 53, wherein rotation of the rotating element 55 causes rotation of the second helical gear 53. As can be seen in FIG. 12, the rotating element 55 and lever 45 are disposed such that they are operable from the exterior of the sprocket cover 37. As shown in FIGS. 9 and 10, the lever 45 is constructed such that raising the lever and pressing it inward toward the interior of the chain saw enables engagement of the cylindrical element 43 with the hexagonal nut 39.

Figure 13:
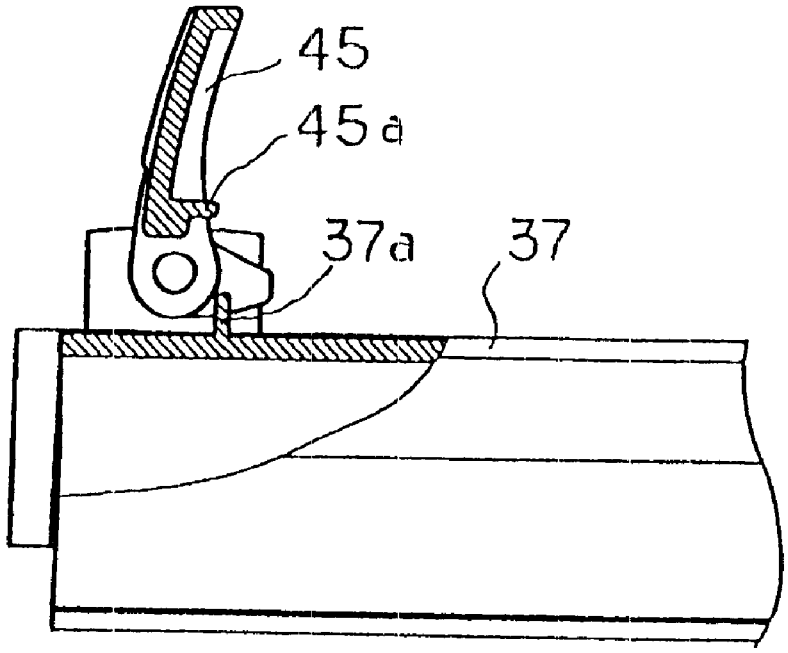
FIG. 13 is a cross-sectional view showing the main portion of the lever and sprocket cover of the chain saw in accordance with the second embodiment.
Figure 14:
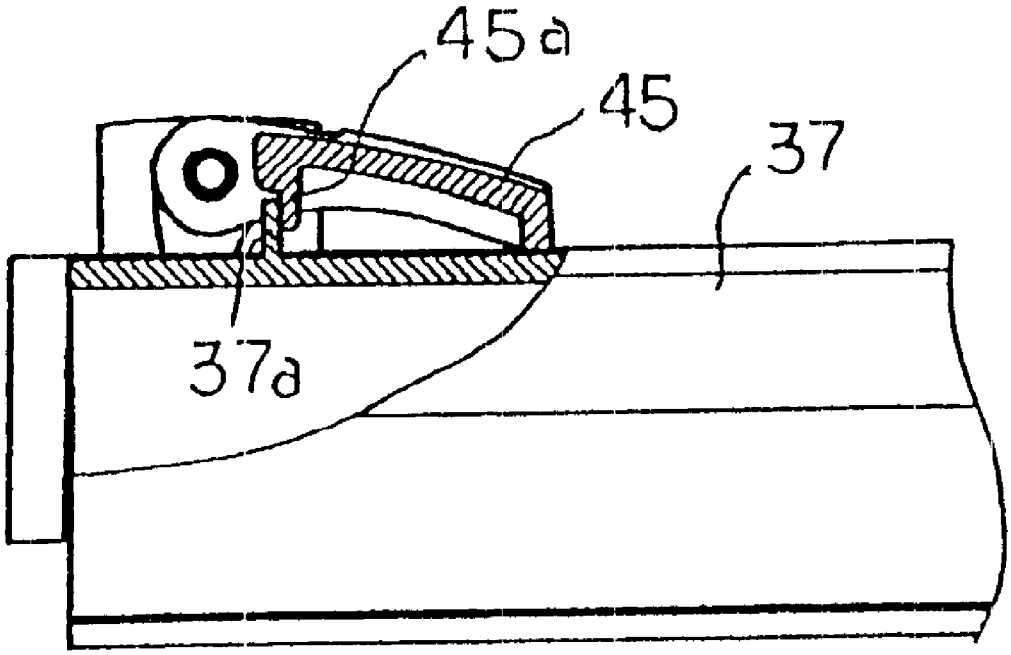
FIG. 14 is a cross-sectional view showing the main portion of the lever and sprocket cover of the chain saw in accordance with the second embodiment.

In one departure from the chain saw 1 according to the first embodiment, the chain saw 30 according to the second embodiment includes a pair of lugs 57 disposed on the top surface of the rotating element 55. The provision of these lugs 57 greatly enhances the operability of the unit when rotating the rotating element 55. Furthermore, as shown in FIGS. 13 and 14, a rib 45*a* is provided on the lever 45, and a rib 37*a* is provided on the sprocket cover 37. Thus, folding down the lever 45 to the lowered position causes engagement of the ribs 45*a* and 37*a*, enabling the lever 45 to remain securely in the lowered position.

Figure 15:
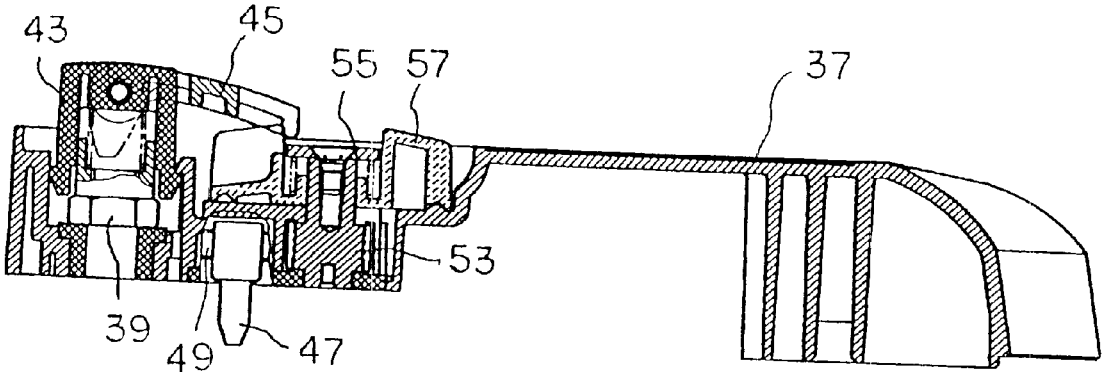
FIG. 15 is a cross-sectional view showing the main portion of the sprocket cover of the chain saw in accordance with the second embodiment.

Additionally, as shown in FIG. 15, the hexagonal nut 39, the cylindrical element 43, the adjustment pin 47, the screw stock 49, and the first helical gear 51 (omitted in this figure) and the second helical gear 53 are disposed in the interior of the sprocket cover 37 so as to be integrally removable with the sprocket cover from the main body 33 of the chain saw 30. In a chain saw 30 so constructed, the hexagonal nut 39 and other components are not only removed along with the sprocket cover 37 when the sprocket cover is removed from the chain saw, but are also disposed in the sprocket cover, thus helping to prevent loss of any of the various components. As illustrated, the means for adjusting the tension of the chain 7 is disposed within the sprocket cover 37 and covered with a separate cover within the sprocket cover 37. Although not explained, the chain saw 1 of the first embodiment has an identical construction to prevent misplacement of the aforementioned components.

When adjusting the tension of the chain 7 of the chain saw 30, the lever 45 is first pulled up and then pressed into the interior of the chain saw, causing engagement of the hexagonal cavity 41 of the cylindrical element 43 with the hexagonal nut 39. In this condition, the lever 45 is then rotated to loosen the hexagonal nut 39. Next, when the lugs 57 are rotated, the rotating element 55 is rotated so as to rotate the second helical gear 53 in the desired direction. As the second helical gear 53 rotates, the first helical gear 51 to which it engages also rotates. This in turn causes rotation of the screw stock 49. The adjustment pin 47, which is threadably engaged to the screw stock 49, is moved in the axial direction of the guide bar 31, thus causing the guide bar 31 to move in the axial direction as well. This axial movement of the guide bar 31 permits adjustment of the tension of the chain 7. When adjustment of the tension of the chain 7 is completed, the lever 45 is pressed in toward the interior of the chain saw, whereupon the hexagonal cavity 41 of the cylindrical element 43 engages the hexagonal nut 39, and the lever 45 is rotated in the direction opposite that used previously. This rotates the hexagonal nut 39 so as to tighten the nut 39, thereby allowing the guide bar 31 to be secured to chain saw's main body 33. In this manner, in the chain saw 30 according to the present invention, adjustment of the tension of the chain 7 can be accomplished without the use of any wrench, screwdriver, or other such tool. Furthermore, the structure of this mechanism is such that the procedure for adjusting the chain tension is greatly simplified. In particular, use of the lugs 57 for rotation of the rotating element 55 is a feature that enhances ease of rotating the rotating element 55, thus providing a greater degree of operability than that available with the chain saw 1 of the first embodiment.

Effect of the Invention

As described above, the chain saw according to the present invention allows adjustment of chain tension without any separate tools being required, and with enhanced operability.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by letters patent is:

1. A chain saw comprising:

a main body;

a chain;

a guide bar for supporting the chain;

an anchor bolt that has an axis and is disposed within the chain saw, the anchor bolt securing the guide bar to the main body;

a hexagonal nut that threadably engages the anchor bolt;

a cylindrical element provided along the same axis as the hexagonal nut and adapted to be both axially movable and rotatable about the same axis as the hexagonal nut, the cylindrical element including, at one end thereof that faces the hexagonal nut, a hexagonal cavity that is adapted to engage the hexagonal nut;

a lever disposed on the opposing end of the cylindrical element from the hexagonal cavity of the cylindrical element, the lever being adapted to move between a raised position and a lowered position;

an adjustment pin that engages the guide bar;

a screw stock that both threadably engages the adjustment pin and extends along an axis of the guide bar;

a first helical gear disposed at one end of the screw stock;

a second helical gear that has an axis of rotation and meshes with the first helical gear such that rotation of the second helical gear causes rotation of the first helical gear;

a rotating element disposed along the same axis of rotation as that of the second helical gear, wherein rotation of the rotating element causes rotation of the second helical gear; and a sprocket cover provided on a side face of the main body, the sprocket cover defining an interior and an exterior thereof, wherein the rotating element and the lever are so arranged as to permit their operation from the exterior of the sprocket cover, and wherein pulling the lever up to the raised position and moving the lever along the axis of the anchor bolt allows the cylindrical element to engage the hexagonal nut.

2. A chain saw as set forth in claim 1, wherein the hexagonal nut, the cylindrical element, the adjustment pin, the screw stock, the first helical gear, and the second helical gear are disposed in the interior of the sprocket cover so as to be integrally removably attached with the sprocket cover to the main body.

3. A chain saw as set forth in claim 1, wherein the lever is so constructed that, when in the lowered position, the lever at least partially covers the rotating element so as to prevent rotation of the rotating element.

4. A chain saw as set forth in claim 2, wherein the lever is so constructed that, when in a lowered position, the lever at least partially covers the rotating element so as to prevent rotation of the rotating element.

5. A chain saw as set forth in claim 1, wherein the lever includes a structure for engaging an outer surface of the cylindrical element when the lever is in the raised position so as to maintain the lever in the raised position.

6. A chain saw as set forth in claim 1, wherein the rotating element has a generally columnar shape having a top surface located substantially flush with an outer surface of the sprocket cover, and wherein the sprocket cover includes a pair of recessed areas formed in the outer surface along the rotating element for facilitating manual rotation of the rotating element.

7. A chain saw as set forth in claim 6, wherein when in the lowered position, the lever covers at least part of the rotating element and at least one of the recessed areas.

8. A chain saw as set forth in claim 1, wherein the rotating element includes at least one lug disposed on a surface thereof for permitting rotation of the rotating element.

9. A chain saw as set forth in claim 1, wherein the lever is attached to said opposing end of the cylindrical element so as to be pivotal between the lowered and raised positions.

10. A chain saw as set forth in claim 1, wherein the sprocket cover includes a setting hole and the lever includes a protrusion for engaging the setting hole when the lever is in the lowered position such that engagement of the protrusion with the setting hole maintains the lever in the lowered position.

11. A chain saw as set forth in claim 1, wherein the sprocket cover includes a first rib and the lever includes a second rib adapted to engage the first rib when the lever is in the lowered position such that engagement of the two ribs maintains the lever in the lowered position.

12. A chain saw as set forth in claim 1, wherein rotation of the rotating element causes rotation of the screw stock, which causes the adjustment pin to rotate and move on the screw stock along the axis of the guide bar, thus moving the guide bar along the axis thereof.

13. A chain saw as set forth in claim 1, wherein when the hexagonal cavity of the cylindrical element is in engagement with the hexagonal nut, the hexagonal nut is adapted to be both loosened from the anchor bolt by manual rotation of the lever to permit axial movement of the guide bar and tightened on the anchor bolt to secure the guide bar to the main body.

* * * * *